US005174080A

United States Patent [19]

Yoshimura et al.

[11] Patent Number: 5,174,080

[45] Date of Patent: Dec. 29, 1992

[54] COLUMN AND BEAM CONNECTING ASSEMBLY

[75] Inventors: Masahiro Yoshimura; Hirooh Tominaga, both of Tokyo; Hideshige Matsuo; Takashi Kitano, both of Kitakyushu; Atsushi Yamada, Tokyo, all of Japan

[73] Assignees: Shimizu Construction Co., Ltd.; Hitachi Metal, Ltd.; Hitachi Metals, Ltd., all of Tokyo, Japan

[21] Appl. No.: 657,167

[22] Filed: Feb. 19, 1991

[30] Foreign Application Priority Data

Feb. 22, 1990 [JP] Japan ..... 2-41821

[51] Int. Cl.[5] ..... E04B 1/00

[52] U.S. Cl. ..... 52/252

[58] Field of Search ..... 52/252, 260

[56] References Cited

U.S. PATENT DOCUMENTS

| | | | |
|---|---|---|---|
| 1,248,049 | 11/1917 | Wunder | 52/60 |
| 1,571,091 | 1/1926 | Lally | 52/260 |
| 1,571,092 | 1/1926 | Lally . | |
| 1,625,899 | 4/1927 | Lally | 52/260 |
| 3,374,592 | 3/1968 | Cheskin | 52/260 |
| 3,593,477 | 7/1971 | Briggs | 52/253 |
| 4,722,156 | 2/1988 | Sato . | |
| 4,905,436 | 3/1990 | Matsuo | 403/174 |

FOREIGN PATENT DOCUMENTS

| | | |
|---|---|---|
| 0218313 | 4/1986 | European Pat. Off. . |
| 190838 | 1/1988 | Japan . |
| 190839 | 1/1988 | Japan . |

*Primary Examiner*—Richard E. Chilcot, Jr.
*Assistant Examiner*—Creighton Smith
*Attorney, Agent, or Firm*—Darby & Darby

[57] ABSTRACT

A connecting assembly is disposed between a concrete column and at least one beam having upper and lower flanges. The connecting assembly has upper and lower first connecting members each having at least one through-hole through which at least one portion of the column is disposed so that both of the first connecting members are mounted on the column. Upper and lower second connecting members are mounted on the upper and lower flange portions of the beam, respectively. The upper and lower second connecting members are affixed respectively to the upper and lower first connecting members by screw engagements, whereby the column is connected to the beam.

18 Claims, 4 Drawing Sheets

COLUMN AND BEAM CONNECTING ASSEMBLY

BACKGROUND OF THE INVENTION

1. Field of the Invention

The present invention pertains to a connecting assembly between a column and at least one beam.

2. Prior Art

For a conventional connecting assembly between a column and a pair of beams, Japanese Patent Application Publication (Kokai) No. 1-190838 is cited. This connecting assembly is described with reference to FIGS. 5 and 6. The connecting assembly 30 is disposed in a concrete-filled steel pipe column 31 of a square cross section, and more specifically, the connecting assembly 30 is located in a space 32 between a pair of coaxially aligned steel pipe portions of the column 31. In the space 32, a diaphragm 33 made of steel by pressing or casting intermediates. Through-holes 34 are formed at the center and at the four corners of the diaphragm 33; concrete is filled in the through-holes 34 so that the diaphragm 33 is mounted to the column 31 in such a manner that the concrete is united with the steel pipes and the diaphragm 33. The diaphragm 32 includes a projecting flange 35 around it, forming a square. The flange 35 includes a pair of projections 36 at the opposite sides thereof. In the drawings, only one diaphragm 33 is shown. However, another diaphragm 33 is mounted below the shown diaphragm 33 in a manner similar to the described diaphragm 33. A pair of beams 37 are unitarily welded to the diaphragm 33 and the steel pipe. The beams 37 are wide flange I-beams, in which the flanges are welded to the projections 36, respectively. Consequently, the beams 37 are connected to the column 31.

However, in the above connecting assembly, the following problems are present:

The flanges or the upper and lower ends of the beams 37 are welded to the projections 36 of the upper and lower diaphragms 33. Accordingly, the positioning of one of the diaphragms 33 must be accurate with respect to the other diaphragm 33. That is, the interval between the diaphragms 33 must be equal to the interval of the upper and lower ends of the beams 37 in order to achieve the rigid connection between the column 31 and the beams 37 by welding. This positioning is very difficult, and thus the productivity is low and the rigidity of the connecting assembly is likely to be poor.

For this reason, the connecting assembly can be applied as long as the column 31 comprises a steel pipe. However, if the steel pipe is not used, the connecting assembly may not be adequate since the flange of the beams 37 may not be supported with sufficient rigidity.

Furthermore, since the connection between the column 31 and the beams 37 is achieved by welding, the productivity is necessarily low.

SUMMARY OF THE INVENTION

It is therefore an object of the present invention to provide a connecting assembly between a column and at least one beam in which the productivity is increased while the workability of filling the concrete into the connecting assembly is facilitated.

Another object of this invention is to provide a connecting assembly in which the dimensional accuracy is enhanced, thus increasing the rigidity of the assembly.

In accordance with one aspect of the present invention, a connecting assembly is disposed between a concrete column and at least one beam. The connecting assembly comprises at least one first connecting member having at least one through-hole through which at least one portion of said column is disposed so that the first connecting member is mounted on the column. The connecting assembly further comprises at least one second connecting member mounted on said at least one beam. The second connecting member is affixed to the first connecting member by screw engagements, whereby said column is connected to said at least one beam.

With such a structure, since the connection between the column and beam is achieved by screw engagements of the first and second connecting members, the productivity of the assembly is increased.

BRIEF DESCRIPTION OF THE DRAWINGS

The foregoing and further objects, features, and advantages of the present invention will be understood more completely from the following detailed description of the preferred embodiments of the present invention, with reference to the accompanying drawings, in which.

DETAILED DESCRIPTION OF THE PREFERRED EMBODIMENTS

Figure 1:
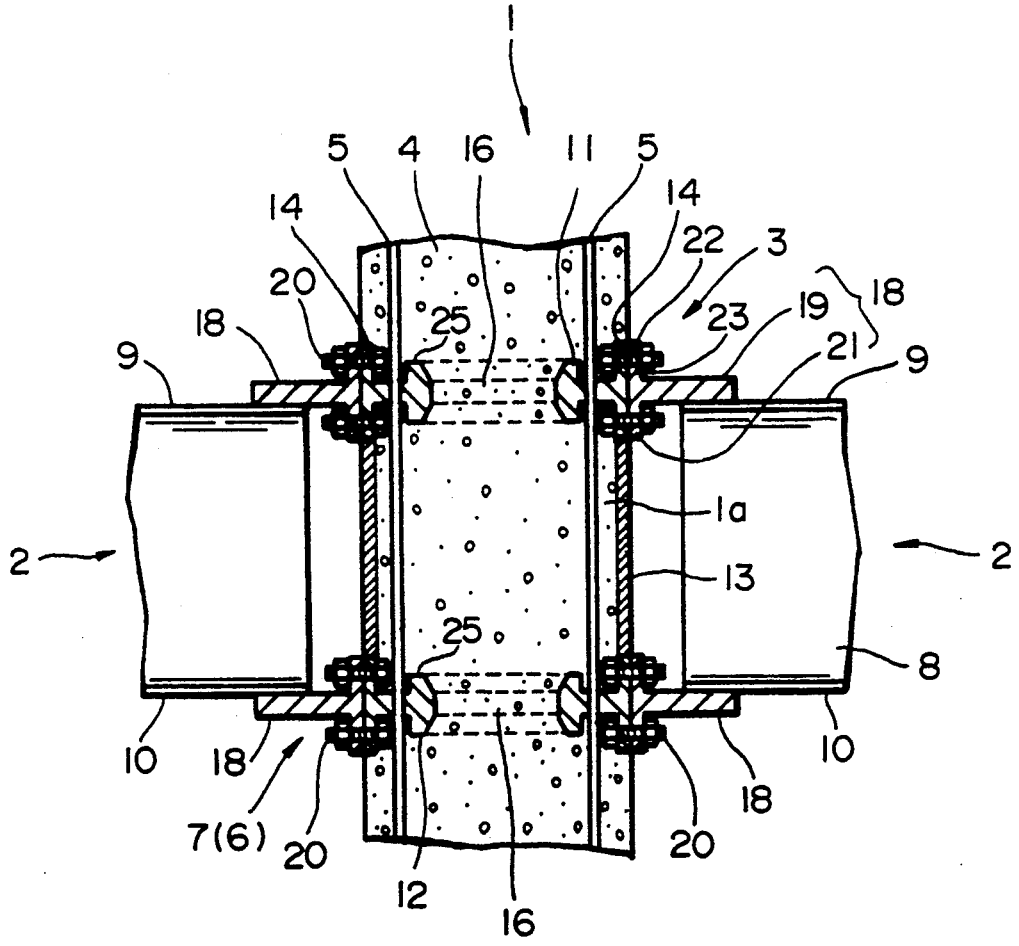
FIG. 1 is a side cross sectional view of a connecting assembly between a column and beams in accordance with a first embodiment of the present invention.

FIGS. 1 through 4 depict a connecting assembly 3 between column 1 and a pair of beams 2, according to an embodiment of the present invention.

The connecting assembly 3 is disposed in and mounted on the column 1. The column 1 comprises a concrete column body 4 of a generally square cross section in which reinforcements 5 are disposed. The column 1 is erected vertically and the reinforcements 5 are also arranged vertically. The column 1 comprises an upper portion and a lower portion which are coaxially aligned with each other. A space 6 is disposed between the upper and lower portions. A connecting device 7 is disposed in the space 6, and is mounted on the concrete column 1.

A pair of beams 2 is mounted on the connecting device 7. Each of the beams 2 is an I-beam of which the upper and lower flange portions 9 and 10 are disposed horizontally. The flange portions 9 and 10 are connected through the web portion 8 in a conventional manner.

Figure 3:
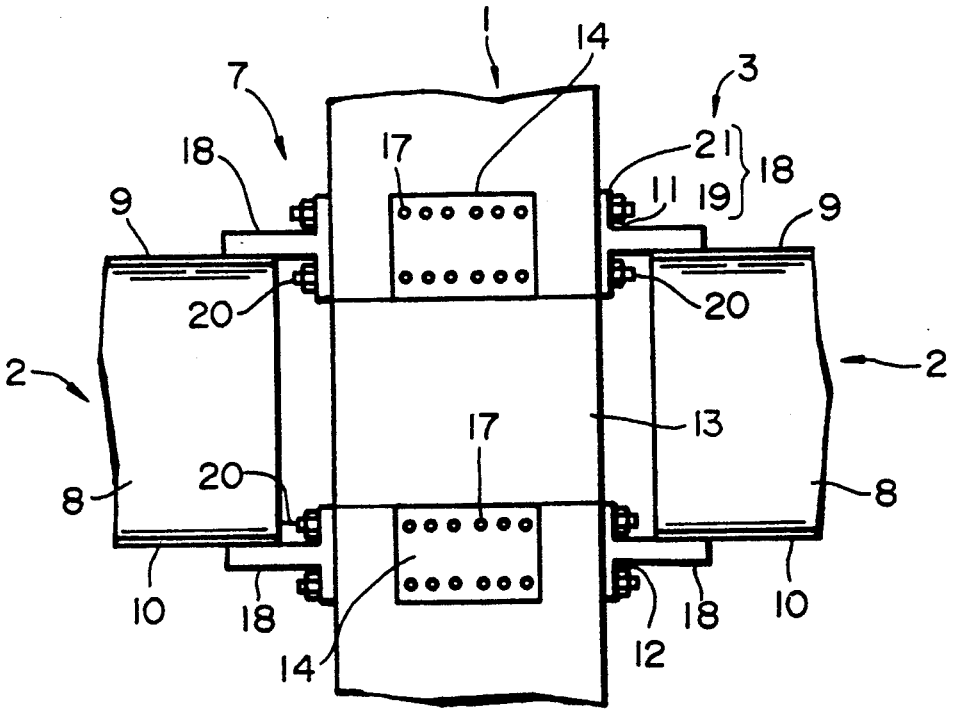
FIG. 3 is a side view of the connecting assembly in FIG. 1.

As best shown in FIG. 3, the connecting device 7 comprises an upper first connecting member 11, a lower first connecting member 12, and a tubular intermediate member 13 disposed between the connecting members 11 and 12. Each of the connecting members 11 and 12, and the tubular intermediate member 13 is made of steel and is manufactured unitarily by welding the intermediate member 13 to the upper and lower connecting members 11 and 12. As illustrated in FIG. 1, the intermediate member 13 encases a portion la of the column 1 which intermediates between, and is united to, said upper and lower portions of the column 1.

The upper and lower first connecting members 11 and 12 are connected to the upper and lower flange portions 9 and 10, respectively. Therefore, the interval between the upper and lower connecting members 11 and 12 is adjusted to the interval between the upper and lower flange portions 9 and 10 when the connecting device 7 is manufactured. More specifically, the height of the intermediate member 13 is substantially conformed to the interval between the upper and lower flange portions 9 and 10.

Figure 4:
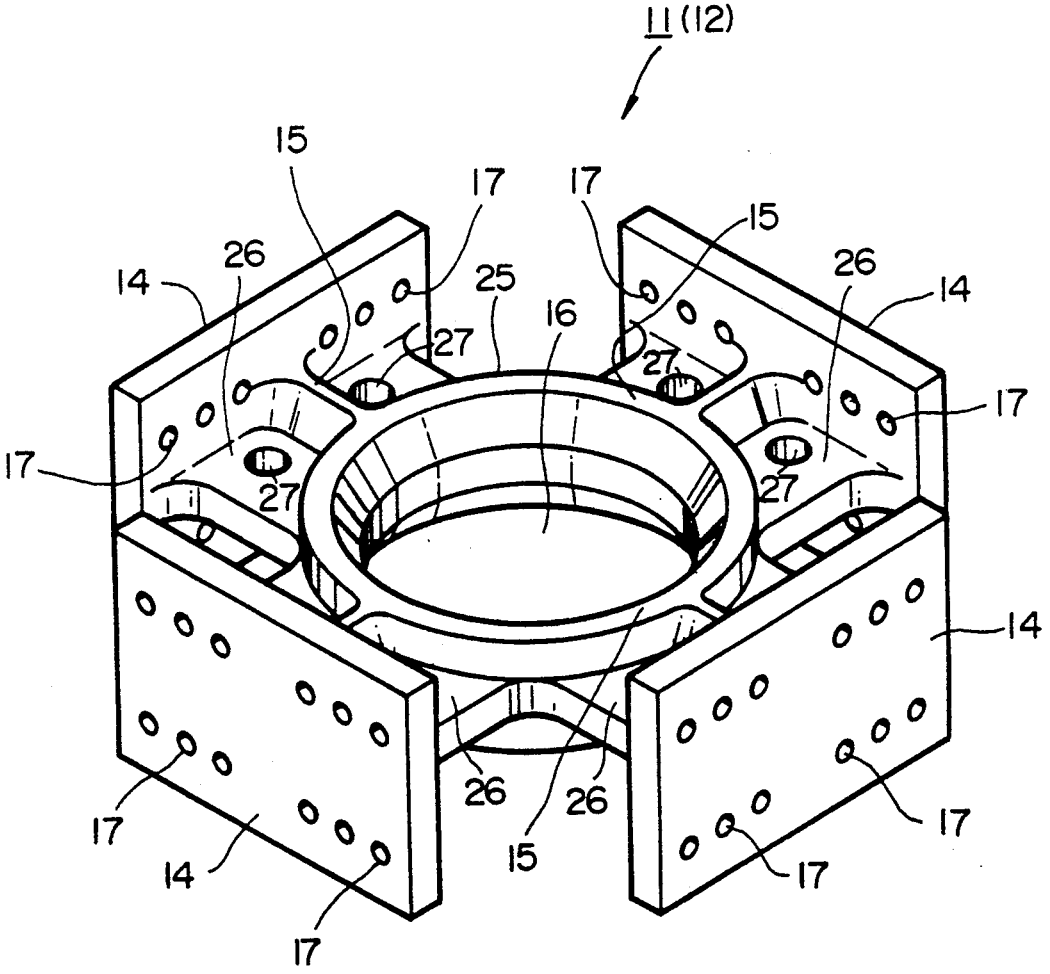
FIG. 4 is a perspective view of a first connecting member which is utilized in the connecting assembly in FIG. 1.
Figure 5:
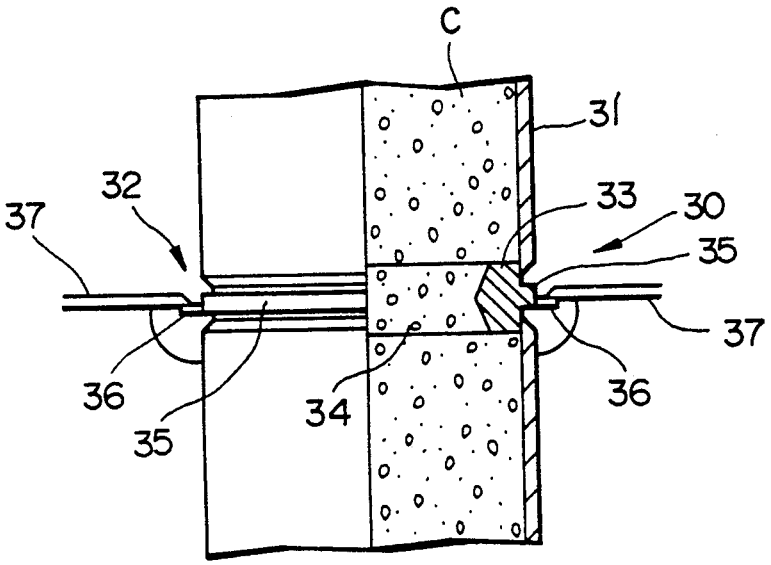
FIG.5 (PRIOR ART)
FIG. 5 is a side view of a connecting assembly between a column and beams of a prior art.
Figure 6:
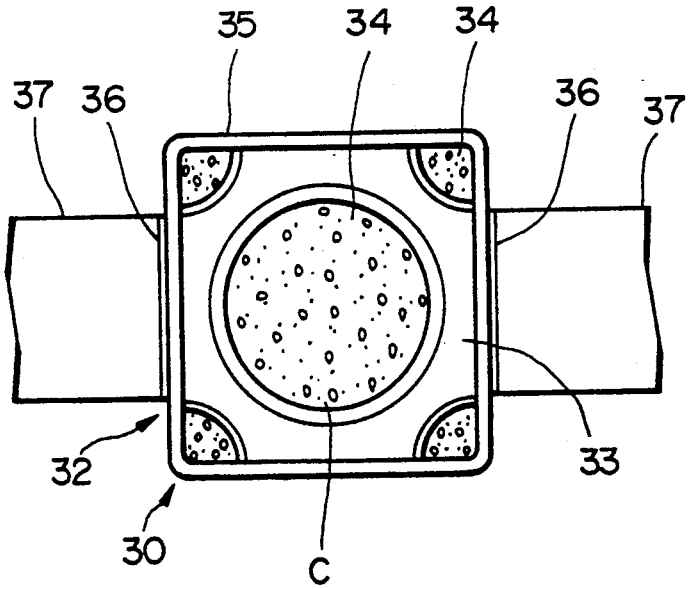
FIG.6 (PRIOR ART)
FIG. 6 is a horizontal sectional view of the connecting assembly in FIG. 5.

FIG. 4 depicts a first connecting member 11 in greater detail. The first connecting member 12 is in a form similar to that of the connecting member 11. The connecting member 11 (12) is a diaphragm of a generally square shape so as to conform with cross section of the column 1. The connecting member 11 includes a ring-shaped central body 25 which may be embedded in the concrete body 4 of the column 1. The connecting member 11 further includes four protruding plates 26 which protrude outwardly from the ring-shaped central body 25. The protruding plates 26 are oriented horizontally and are disposed at angularly equal intervals. In addition, four rectangular connecting plates 14 are mounted on the central body 25 via the protruding plates 26, respectively. The connecting plates 14 are oriented vertically and are disposed at angularly equal intervals. Each of the protruding plates 26 and the central body 25 is reinforced by ribs 15 which are provided respectively thereto.

Figure 2:
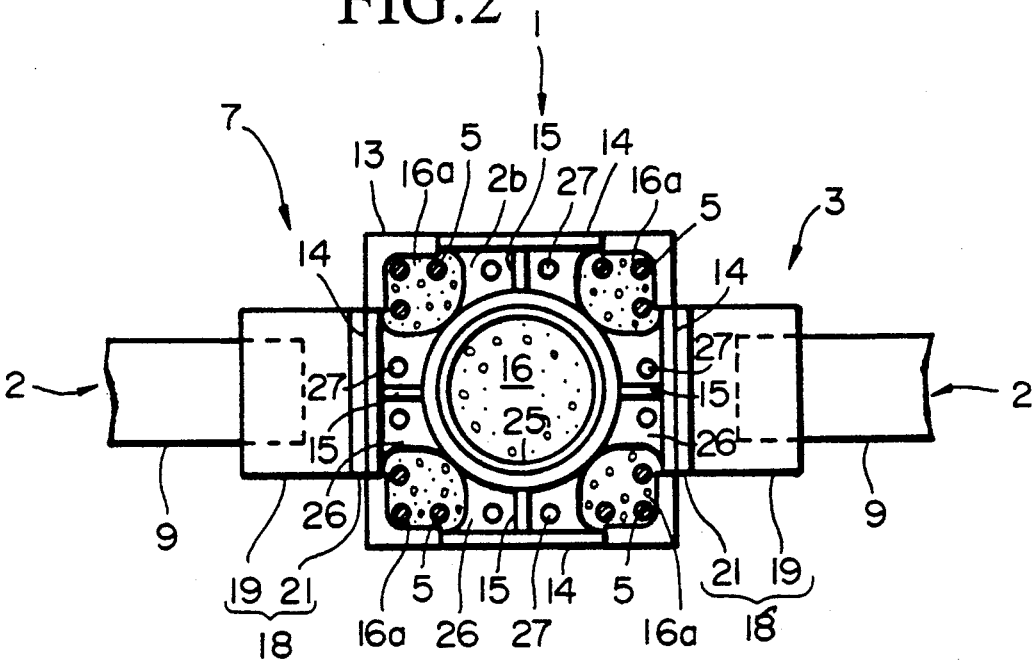
FIG. 2 is a top view of the connecting assembly in FIG. 1, wherein a part shows the horizontal cross section.

The central body 25 of the first connecting member 11 (12) includes a central through-hole 16 through which can be inserted a tremie tube for supplying concrete. As best shown in FIG. 2, four corner spaces 16*a* defined by the protruding plates 26, connecting plates 14, and corner molds for concrete (not shown) are also provided in order that the tremie tube can be inserted through the corner spaces 16*a*. Moreover, said reinforcements 5 may be inserted through the through-hole 16 and the corner spaces 16*a*. A plurality of through-holes 27 are formed on the protruding plates 26 of the connecting member 11 for allowing the escape of air during the pouring of concrete.

In addition, a plurality of through-holes 17 are formed at the respective connecting plates 14 in order that bolts can be inserted through the respective through-holes 17.

The first connecting member 11 is manufactured unitarily by casting or pressing. As mentioned above, the connecting member 12 is the same shape as the connecting member 11.

Said steel tubular intermediate member 13, which is of a square cross section, is mounted on the connecting plates 14 of the connecting members 11 and 12 unitarily as illustrated in FIGS. 1 and 3.

On the other hand, second connecting members 18 are mounted on the upper and lower flange portions 9 and 10 of said respective beams 2. Each of the second connecting members 18 has a horizontally extending portion 19 and a vertically oriented portion 21 which are manufactured unitarily with each other. The horizontally extending portion 19 is welded to the upper surface of the upper flange portion 9 or to the lower surface of the lower flange portion 10. Alternatively, the horizontally extending portion 19 may mounted on the beams 2 by screw engagements with nuts and bolts.

Each of the vertically oriented portions 21 is mounted on one of the connecting plates 14 of the first connecting members 11 and 12 by screw engagements with nuts 23 and bolts 21. Thus, each of the vertically oriented portions 21 of the second connecting members 18 is provided with through-holes 22 through which bolts 21 can be inserted. The through-holes 22 are formed at locations where the respective through-holes 17 of the connecting plates 17 of the first connecting members 11 and 12 coincide. Accordingly, the end portions of the beams 2 are connected to the first connecting members 11 and 12 via the second connecting members 18, and thus the beams 2 are connected to the column 1.

The connecting assembly 3 is assembled in the following manner. First of all, the intermediate member 13 is mounted on the connecting plates 14 of the connecting members 11 and 12 unitarily, whereby the connecting device 7 is assembled. Next, the connecting device 7 is installed at the top of the lower portion of the concrete column 1 in such a manner that the reinforcements 5 are disposed along the connecting device 7 and are inserted through the through-holes 16 and the corner spaces 16*a*. Before the installation of the connecting device 7, the lower portion of the concrete column 1 is already produced.

On the other hand, the second connecting members 18 are mounted on the end portions of the beams 2. Then, the beams 2 are lifted to a prescribed elevation where the beams 2 are coincident with the connecting device 7. Next, the beams 2 are connected to the connecting device 7 by screw engagements with nuts 23 and bolts 21. At that time, from inside of the connecting device 7, the bolts 21 are inserted into the bolt-through-holes 17 of the first connecting members 11 and 12, and are next inserted into the bolt-through-holes 22 of the second connecting members 18. Then, the nuts 23 are engaged with the bolts 21, respectively, at the outside of the connecting device 7, so that the connecting plates 14 of the first connecting members 11 and 12 and the vertically oriented portions 21 of the second connecting members 18 are fastened tightly with the nuts and bolts.

Then, a concrete forming mold (not shown) is disposed on the connecting device 7 in order to form the upper portion of the column 1. The tremie tube is inserted into the through-hole 16 and/or the corner spaces 16*a*, so that concrete can flow into the space defined by the tubular intermediate member 13 and the forming mold. Consequently, the tubular member 13 and then the forming mold are filled with the concrete 4, thereby constructing the continuous concrete column 1 including said upper, lower, and intermediate portions.

Another installation method is described in the following. First, the lower second connecting members 18, which will be mounted on the lower flange portions 10 of the beams 2 later, are mounted on the lower first connecting members 12 of the connecting device 7. The upper second connecting members 18 are mounted on the upper flange portion 9 of the beam 2. Next, the beams 2 are lifted to the prescribed elevation, and the lower flange portions 10 of the beam 2 are affixed to the lower second connecting members 18. Lastly, the upper second connecting members 18 are affixed to the upper first connecting member 11 of the connecting device 7 with the nuts and bolts.

With the above-described connecting assembly 3, since the connection between the column 1 and the beams 2 is achieved by screw engagements of the first connecting members 11 and 12 and second connecting members 18, the assembly 3 can be constructed easily at the construction site. Additionally, since welding of the structural components at the construction site is unnecessary, the productivity of the assembly 3 is increased, and the time taken for the construction can be shortened.

Furthermore, since the connection between the column 1 and the beams 2 is achieved by screw engagements of the first connecting members 11 and 12 and second connecting members 18, thereby excluding welding of the structural components at the construction site, slight adjustment of the beams 2 with respect to the column 1 can be performed utilizing the clearance existing between the bolt-through-holes 17 and 22 and the bolts 20. In addition, it is possible to alter the beams 2 if necessary.

The above-explained advantages are possible not only in single-storied buildings but also multistoried buildings.

In addition, the interval between the upper and lower connecting members 11 and 12 for mounting the upper and lower flanges 9 and 10 of the beams 2 is defined by the size of the tubular member 13, thereby enhancing the dimensional accuracy of the connecting assembly 3. Consequently, high productivity and the improved rigidity of the connecting assembly 3 are ensured.

Furthermore in the above embodiment, both upper and lower flange portions 9 and 10 of each beam 2 are connected to the column 1. Therefore, the rigidity and durability of the entire connecting assembly 3 is enhanced.

Furthermore, there are provided through-holes 16 and the corner spaces 16*a* at each of the first connecting members 11 and 12 through which can be inserted a tremie tube for supplying concrete 4. Accordingly, the pouring of the concrete may be performed efficiently.

Moreover, since said upper, intermediate, and lower portions of the concrete column 1 can be manufactured unitarily and in a unitary concrete body 4, the concretecolumn 1 is of a superior mechanical strength and rigidity. Thus, the rigidity and strength of the entire connecting assembly 3 can be enhanced.

Although a preferred embodiment of the present invention has been disclosed for illustrative purpose, those skilled in the art will appreciate that various modifications, additions, and substitutions are possible, without departing from the scope and spirit of the invention as stated in the accompanying claims.

For example, it is possible to exclude the intermediate member 13. Instead of the intermediate member 13, the first connecting members 11 and 12 can be affixed to and supported by networking of the reinforcements 5. In this case, the reinforcements 5 with the first connecting members 11 and 12 may be installed on the column 1 already constructed, and then the beams 2 with second connecting members 18 are affixed to the first connecting members 11 and 12 in a manner similar to the above description.

In addition, in the above preferred embodiment, welding of the structural components at the construction site is omitted. However, if it is necessary to improve the rigidity and durability of the entire connecting assembly 3 due to structural demands, it is optional to provide any other supplemental means for increasing such mechanical properties. For example, gusset plates may be welded to the intermediate member 13, and the web portions 8 of the beams 2 are mounted on the gusset plate by nuts and bolts.

Furthermore, in the preferred embodiment, the above structure is applied to the reinforced concrete column. However, it is possible to apply the above structure to a concrete-filled steel tube column.

What is claimed is:

1. A connecting assembly between a column and at least one beam comprising:

at least one first connecting beam having at least one through-hole through which at least one portion of said column is disposed so that the first connecting means is mounted on the column, the first connecting means including a ring-shaped central body which has the through-hole in the center thereof and which is embedded in a concrete body of said column, and further including at least one connecting plate which protrudes from the central body and which has a plurality of bolt-through-holes; and at least one second connecting means mounted on said at least one beam, the second connecting member being affixed to the first connecting means by screw engagements through said bolt-through-holes of said connecting plate, whereby the column is connected to said at least one beam.

2. A connecting assembly as recited in claim 1, wherein said column comprises a concrete body, said concrete body being disposed through the through-hole of said first connecting member.

3. A connecting assembly as recited in claim 2, wherein said column comprises reinforcements embedded in the concrete body, the reinforcements being inserted through the through-hole of said first connecting member.

4. A connecting assembly as recited in claim 1, wherein said central body is provided so that a tremie tube for supplying concrete can be inserted through the through-hole in the center of the central body.

5. A connecting assembly as recited in claim 4, further comprising a rigid intermediate member disposed between the upper and lower first connecting members, the intermediate member maintaining an interval between the upper and lower first connecting members, which is equal to an interval between said upper and lower second connecting members.

6. A connecting assembly as recited in claim 5, wherein said upper first connecting member, said lower first connecting member, and said intermediate member comprise a unitary rigid body.

7. A connecting assembly as recited in claim 6, wherein said upper first connecting member, said lower first connecting member, and said intermediate member are made of steel, said tubular member being welded to said upper and lower first connecting members.

8. A connecting assembly as recited in claim 4, wherein said column comprises a concrete body, said concrete body being disposed through the through-holes of said upper and lower first connecting members.

9. A connecting assembly as recited in claim 8, wherein said column comprises reinforcements embedded in the concrete body, the reinforcements being inserted through the through-holes of said upper and lower first connecting members.

10. A connecting assembly as recited in claim 5, wherein said column comprises a concrete body, said concrete body being disposed through the through-holes of said upper and lower first connecting members, said intermediate member being of a tubular shape unitarily encasing a portion of the concrete body of the column.

11. A connecting assembly as recited in claim 10, wherein said column comprises reinforcements embedded in the concrete body, the reinforcements being inserted through the through-holes of said upper and lower first connecting members and through said tubular intermediate member.

12. A connecting assembly as recited in claim 5, wherein each of said first connecting members includes a central body having said through-hole, the central body being embedded in said concrete body of said column, each of said first connecting members further includes at least one connecting plate which protrudes from the central body and which has a plurality of bolt-through-holes through which bolts of said screw engagements can be inserted so as to be capable of being affixed to one of said second upper and lower connecting members.

13. A connecting device for connecting between a column and at least one beam, the beam having an upper flange portion and a lower flange portion, a pair of second connecting means mounted on the upper and lower flange portions, respectively, the connecting device comprising:

upper and lower first connecting means each having at least one through-hole through which at least one portion of said column is disposed so that the first connecting means of the connecting device are mounted on the column, each of the upper and lower first connecting means including a central body which has a respective one of the through-holes in the center thereof and which is embedded in a concrete body of said column, and further including at least one connecting plate which protrudes from the ring-shaped central body and which has a plurality of bolt-through-holes; and an intermediate means disposed between the upper and lower first connecting means of the connecting device, the upper and lower first connecting means of the connecting device capable of being affixed respectively to the aforementioned second connecting means mounted on the upper and lower flange portions of the beam by screw engagements through said bolt-through-holes of said connecting plate, whereby said column is connected to said at least one beam.

14. A connecting device as recited in claim 14, wherein said upper connecting member, said lower connecting member, and said intermediate member comprise a unitary rigid body.

15. A connecting device as recited in claim 15, wherein said upper connecting member, said lower connecting member, and said intermediate member are made of steel, said intermediate member being welded to said upper and lower connecting members.

16. A connecting device as recited in claim 14, wherein said intermediate member is of a tubular shape capable of encasing unitarily a portion of the concrete body of the column.

17. A connecting assembly for connecting a column with a beam comprising:

an upper first connecting means having a structure so that the upper first connecting means can be mounted on the column to constitute a part of said column, the upper first connecting means including a ring-shaped central body which has a through-hole in the center thereof, and further including at least a connecting plate which protrudes from the central body and which has a plurality of bolt-through-holes;

an upper second connecting means having a structure so that the upper second connecting means may be mounted on an upper flange portion of said beam and may be affixed to the upper first connecting means by screw engagements through said bolt-through-holes of the connecting plate of the upper first connecting means, whereby said column can be connected to an upper flange portion of the beam;

a lower first connecting means provided separately from said upper first connecting means and having a structure so that the lower first connecting means may be mounted on the column to constitute a part of said column, the lower first connecting means including a ring-shaped central body which has a through-hole in the center thereof, and further including at least a connecting plate which protrudes from the central body and which has a plurality of bolt-through-holes; and a lower second connecting means having a structure so that the lower second connecting means may be mounted on a lower flange portion of said beam, and may be affixed to the lower first connecting means by screw engagements through said bolt-through-holes of the connecting plate of the lower first connecting means, whereby said column can be connected to a lower flange portion of the beam.

18. A connecting assembly as recited in claim 17, wherein each of the through-holes of the ring-shaped central bodies of the upper and lower first connecting means is adapted to permit a tremie tube to be inserted therein and each of the ring-shaped central bodies of the upper and lower first connecting means is adapted to be embedded in a concrete body of the column.

* * * * *